US011183351B2

(12) United States Patent
Lim et al.

(10) Patent No.: US 11,183,351 B2
(45) Date of Patent: Nov. 23, 2021

(54) RELAY DEVICE

(71) Applicant: LS AUTOMOTIVE TECHNOLOGIES CO., LTD., Gyeonggi-Do (KR)

(72) Inventors: Jae-Yoon Lim, Gyeonggi-do (KR); Yeon-Muk Choi, Gyeonggi-do (KR)

(73) Assignee: LS AUTOMOTIVE TECHNOLOGIES CO., LTD., Gyeonggi-Do (KR)

( * ) Notice: Subject to any disclaimer, the term of this patent is extended or adjusted under 35 U.S.C. 154(b) by 287 days.

(21) Appl. No.: 16/469,536

(22) PCT Filed: Oct. 31, 2017

(86) PCT No.: PCT/KR2017/012184
§ 371 (c)(1),
(2) Date: Jun. 13, 2019

(87) PCT Pub. No.: WO2018/117397
PCT Pub. Date: Jun. 28, 2018

(65) Prior Publication Data

US 2019/0304723 A1 Oct. 3, 2019

(30) Foreign Application Priority Data

Dec. 23, 2016 (KR) ..... 10-2016-0178389

(51) Int. Cl.
*H01H 1/00* (2006.01)
*H01H 50/12* (2006.01)
(Continued)

(52) U.S. Cl.
CPC ..... *H01H 50/12* (2013.01); *H01H 45/02* (2013.01); *H01H 45/12* (2013.01); *H01H 50/02* (2013.01); *H01H 50/56* (2013.01); *H01H 51/29* (2013.01)

(58) Field of Classification Search
CPC ..... H01H 50/12; H01H 45/02; H01H 45/12; H01H 50/02; H01H 50/56; H01H 51/29; H01H 2050/44; H01H 50/026
(Continued)

(56) References Cited

U.S. PATENT DOCUMENTS 4,310,818 A * 1/1982 Essler ..... H01H 11/06 200/246
4,405,911 A * 9/1983 Hasegawa ..... H01H 50/02 335/135
(Continued)

FOREIGN PATENT DOCUMENTS

EP 1772884 A2 4/2007
JP 3898021 B2 3/2007
(Continued)

OTHER PUBLICATIONS

International Search Report from corresponding PCT Application No. PCT/KR2017/012184, dated Mar. 6, 2018, with English translation.

*Primary Examiner* — Shawki S Ismail
*Assistant Examiner* — Lisa N Homza
(74) *Attorney, Agent, or Firm* — Harness, Dickey & Pierce, P.L.C.

(57) ABSTRACT

A relay device includes an electronic block configured to selectively generate an electromagnetic force by means of a coil; two fixed contact point terminals at which fixed contact points are respectively installed; a movable contact point assembly having a movable contact point installed at a front end thereof, the movable contact point being fluctuated by the electromagnetic force to be contacted with or separated from the fixed contact points; and a base block configured to hold the electronic block, the fixed contact point terminals and the movable contact point assembly, which are accommodated in a cover. An entire space inside the cover is
(Continued)

divided into two regions based on a contact surface between the fixed contact point and the fixed contact point terminal.

1 Claim, 11 Drawing Sheets

(51) Int. Cl.
*H01H 50/02* (2006.01)
*H01H 45/02* (2006.01)
*H01H 45/12* (2006.01)
*H01H 50/56* (2006.01)
*H01H 51/29* (2006.01)

(58) Field of Classification Search
USPC ..... 335/196
See application file for complete search history.

(56) References Cited

U.S. PATENT DOCUMENTS 4,516,099 A * 5/1985 Fujii ..... H01H 50/041 200/283
4,709,219 A * 11/1987 Nestlen ..... H01H 50/026 335/129
4,731,597 A * 3/1988 Hinrichs ..... H01H 50/026 335/128
6,337,614 B1 * 1/2002 Tsutsui ..... H01H 50/02 335/160
6,483,407 B1 * 11/2002 Matsuda ..... H01H 50/02 335/202
6,781,490 B2 * 8/2004 Funayama ..... H01H 50/026 335/78
7,335,040 B2 2/2008 Ota et al.
7,358,839 B2 * 4/2008 Mikl ..... H01H 50/56 335/78
7,782,162 B2 * 8/2010 Nishida ..... H01H 50/56 335/201
8,222,979 B2 * 7/2012 Minowa ..... H01H 50/642 335/78
8,305,166 B2 * 11/2012 Kojima ..... H01H 50/60 335/78
8,471,656 B2 * 6/2013 Horii ..... H01H 50/04 335/78
9,082,576 B2 7/2015 Nishimura
10,177,348 B2 1/2019 Takahata
2002/0036556 A1 * 3/2002 Matsuda ..... H01H 50/12 335/78
2005/0057332 A1 * 3/2005 Nakamura ..... H01H 50/042 335/128
2007/0087585 A1 4/2007 Ota et al.
2010/0066468 A1 * 3/2010 Iwamoto ..... H01H 50/026 335/128
2011/0221548 A1 * 9/2011 Yoshihara ..... H01H 51/29 335/185
2013/0057370 A1 * 3/2013 Kubono ..... H01H 50/643 335/177
2015/0015350 A1 * 1/2015 Tachikawa ..... H01H 50/18 335/131
2015/0022292 A1 * 1/2015 Tachikawa ..... H01H 49/00 335/131

FOREIGN PATENT DOCUMENTS

JP 2007-103193 A 4/2007
JP 2011-81961 A 4/2011
KR 10-2010-0125806 A 12/2010
KR 10-2013-0103402 A 9/2013
KR 10-2016-0021248 A 2/2016
KR 10-2016-0049315 A 5/2016
KR 10-2016-0050733 A 5/2016

* cited by examiner

| | Ve/Vt(%) | RY Energized | Contact Point Damage | Contact Resistance(mΩ) |
|---|---|---|---|---|
| 1 | 16.0 | O | C | 110.8 |
| 2 | 16.5 | O | C | 106.2 |
| 3 | 17.0 | O | C | 74.8 |
| 4 | 17.5 | O | C | 65.3 |
| 5 | 18.0 | O | B | 37.9 |
| 6 | 18.5 | O | B | 47.2 |
| 7 | 19.0 | O | A | 16.8 |
| 8 | 19.5 | O | A | 11.5 |
| 9 | 20.0 | O | A | 7.9 |
| 10 | 20.5 | O | A | 5.5 |
| 11 | 21.0 | O | A | 5.4 |
| 12 | 21.5 | O | A | 4.1 |
| 13 | 22.0 | O | A | 5.2 |
| 14 | 22.5 | O | A | 4.6 |
| 15 | 23.0 | O | A | 3.8 |
| 16 | 23.5 | O | A | 3.9 |
| 17 | 24.0 | O | A | 3.5 |
| 18 | 24.5 | O | A | 4.1 |
| 19 | 25.0 | O | A | 4.5 |
| 20 | 25.5 | O | A | 4.7 |
| 21 | 26.0 | O | A | 3.9 |
| 22 | 26.5 | O | A | 4.5 |
| 23 | 27.0 | O | A | 2.4 |
| 24 | 27.5 | O | A | 3.8 |
| 25 | 28.0 | O | A | 4.0 |
| 26 | 28.5 | O | A | 5.0 |
| 27 | 29.0 | O | A | 3.6 |
| 28 | 29.5 | O | A | 5.4 |
| 29 | 30.0 | O | A | 5.5 |
| 30 | 30.5 | O | A | 3.3 |
| 31 | 31.0 | O | A | 5.4 |
| 32 | 31.5 | O | A | 3.3 |
| 33 | 32.0 | O | A | 4.1 |
| 34 | 32.5 | O | A | 4.0 |
| 35 | 33.0 | O | A | 6.2 |
| 36 | 33.5 | O | A | 2.5 |
| 37 | 34.0 | O | A | 3.6 |

FIG. 5

| | Vr/Ve(%) | RY Energized | Contact Point Damage | Contact Resistance(mΩ) | | Vr/Ve(%) | RY Energized | Contact Point Damage | Contact Resistance(mΩ) |
|---|---|---|---|---|---|---|---|---|---|
| 1 | 16.0 | O | A | 3.8 | 31 | 31.0 | O | A | 0.9 |
| 2 | 16.5 | O | A | 6.2 | 32 | 31.5 | O | A | 4.4 |
| 3 | 17.0 | O | A | 2.6 | 33 | 32.0 | O | A | 1.2 |
| 4 | 17.5 | O | A | 4.8 | 34 | 32.5 | O | A | 5.1 |
| 5 | 18.0 | O | A | 1.8 | 35 | 33.0 | O | A | 3.6 |
| 6 | 18.5 | O | A | 4.2 | 36 | 33.5 | O | A | 1.6 |
| 7 | 19.0 | O | A | 6.3 | 37 | 34.0 | O | A | 1.8 |
| 8 | 19.5 | O | A | 5.1 | 38 | 34.5 | O | A | 1.1 |
| 9 | 20.0 | O | A | 1.9 | 39 | 35.0 | O | A | 0.6 |
| 10 | 20.5 | O | A | 4.4 | 40 | 35.5 | O | A | 5.6 |
| 11 | 21.0 | O | A | 1.8 | 41 | 36.0 | O | A | 1.3 |
| 12 | 21.5 | O | A | 3.8 | 42 | 36.5 | O | A | 1.5 |
| 13 | 22.0 | O | A | 1.6 | 43 | 37.0 | O | A | 2.0 |
| 14 | 22.5 | O | A | 1.7 | 44 | 37.5 | O | A | 1.6 |
| 15 | 23.0 | O | A | 1.7 | 45 | 38.0 | O | A | 1.1 |
| 16 | 23.5 | O | A | 1.4 | 46 | 38.5 | O | A | 1.8 |
| 17 | 24.0 | O | A | 1.2 | 47 | 39.0 | O | A | 4.8 |
| 18 | 24.5 | O | A | 1.9 | 48 | 39.5 | O | A | 6.4 |
| 19 | 25.0 | O | A | 1.8 | 49 | 40.0 | O | A | 5.9 |
| 20 | 25.5 | O | A | 2.1 | 50 | 40.5 | O | A | 7.8 |
| 21 | 26.0 | O | A | 1.2 | 51 | 41.0 | O | A | 8.9 |
| 22 | 26.5 | O | A | 1.5 | 52 | 41.5 | O | A | 13.2 |
| 23 | 27.0 | O | A | 5.2 | 53 | 42.0 | O | A | 7.3 |
| 24 | 27.5 | O | A | 5.5 | 54 | 42.5 | O | B | 31.5 |
| 25 | 28.0 | O | A | 3.1 | 55 | 43.0 | O | B | 26.8 |
| 26 | 28.5 | O | A | 1.9 | 56 | 43.5 | O | B | 32.6 |
| 27 | 29.0 | O | A | 2.6 | 57 | 44.0 | O | B | 27.2 |
| 28 | 29.5 | O | A | 2.4 | 58 | 44.5 | O | B | 37.4 |
| 29 | 30.0 | O | A | 2.4 | 59 | 45.0 | O | B | 35.7 |
| 30 | 30.5 | O | A | 2.4 | 60 | 45.5 | O | B | 41.2 |

FIG. 6

| | Vr/Ve(%) | RY Energized | Contact Point Damage | Contact Resistance(mΩ) | | Vr/Ve(%) | RY Energized | Contact Point Damage | Contact Resistance(mΩ) |
|---|---|---|---|---|---|---|---|---|---|
| 1 | 16.0 | O | B | 17.9 | 31 | 31.0 | O | B | 237.5 |
| 2 | 16.5 | O | B | 27.2 | 32 | 31.5 | O | B | 239.1 |
| 3 | 17.0 | O | B | 18.9 | 33 | 32.0 | O | B | 317.2 |
| 4 | 17.5 | O | B | 24.1 | 34 | 32.5 | O | B | 394.5 |
| 5 | 18.0 | O | B | 22.3 | 35 | 33.0 | O | B | 247.2 |
| 6 | 18.5 | O | B | 23.4 | 36 | 33.5 | O | B | 356.2 |
| 7 | 19.0 | O | B | 21.7 | 37 | 34.0 | O | B | 317.9 |
| 8 | 19.5 | O | B | 22.8 | 38 | 34.5 | O | B | 327.2 |
| 9 | 20.0 | O | B | 21.6 | 39 | 35.0 | O | B | 338.1 |
| 10 | 20.5 | O | B | 23.7 | 40 | 35.5 | O | B | 394 |
| 11 | 21.0 | O | B | 28.1 | 41 | 36.0 | O | B | 328 |
| 12 | 21.5 | O | B | 37.9 | 42 | 36.5 | O | B | 347 |
| 13 | 22.0 | O | B | 36.8 | 43 | 37.0 | O | B | 329.3 |
| 14 | 22.5 | O | B | 35.2 | 44 | 37.5 | O | B | 461.9 |
| 15 | 23.0 | O | B | 46.9 | 45 | 38.0 | O | B | 367.5 |
| 16 | 23.5 | O | B | 37.5 | 46 | 38.5 | O | B | 418.3 |
| 17 | 24.0 | O | B | 54.2 | 47 | 39.0 | O | B | 428.6 |
| 18 | 24.5 | O | B | 56.1 | 48 | 39.5 | O | B | 421 |
| 19 | 25.0 | O | B | 62.8 | 49 | 40.0 | O | B | 1278 |
| 20 | 25.5 | O | B | 65.5 | 50 | 40.5 | O | B | 2715 |
| 21 | 26.0 | O | B | 78.3 | 51 | 41.0 | O | B | 2378 |
| 22 | 26.5 | O | B | 92.8 | 52 | 41.5 | O | B | 2354 |
| 23 | 27.0 | O | B | 120.9 | 53 | 42.0 | O | B | 3871 |
| 24 | 27.5 | O | B | 230.8 | 54 | 42.5 | X | D | 3548 |
| 25 | 28.0 | O | B | 275 | 55 | 43.0 | X | D | 2317 |
| 26 | 28.5 | O | B | 286.3 | 56 | 43.5 | X | D | 3549 |
| 27 | 29.0 | O | B | 312 | 57 | 44.0 | X | D | 5463 |
| 28 | 29.5 | O | B | 356.4 | 58 | 44.5 | X | D | 3216 |
| 29 | 30.0 | O | B | 418.5 | 59 | 45.0 | X | D | 2178 |
| 30 | 30.5 | O | B | 231 | 60 | 45.5 | X | D | 3571 |

FIG. 7

RELAY DEVICE

CROSS-REFERENCE TO RELATED APPLICATIONS

This application is a national phase application of PCT Application No. PCT/KR2017/012184, filed on Oct. 31, 2017, which claims the benefit and priority to Korean Patent Application No. 10-2016-0178389, filed on Dec. 23, 2016. The entire disclosures of the applications identified in this paragraph are incorporated herein by references.

FIELD

The present disclosure relates to a relay device, more particularly, to a relay device having a structure in which a fixed contact point and a movable contact point are contacted and separated due to fluctuation.

BACKGROUND

A relay device is a switching mechanism that operates when an input signal reaches a certain value to open and close another electric circuit, and is widely used in various industrial fields such as vehicles, industrial automation control devices, and the like. The relay device may be classified into a ladder-type relay device and a cantilever-type relay device.

In the ladder-type relay device, movable contact points linearly move simultaneously with respect to fixed contact points to open and close the contact points. Since the contact point is driven by a large electromagnetic force, the ladder-type relay device is widely used for load control of a large current. A technique related to the ladder-type relay device is disclosed, for example, in Korean Unexamined Patent Publication No. 2010-0125806. The ladder-type relay device disclosed in Korean Unexamined Patent Publication No. 2010-0125806 includes a fixed contact point, a movable contact point arranged to be contactable with and separable from the fixed contact point, and an electronic block for moving the movable contact point.

In the cantilever-type relay device, the movable contact point is pivoted in an arc form with respect to the fixed contact point to open or close the contact point. In the cantilever-type relay device, the movable contact point is attached to a leaf spring with elasticity. The cantilever-type relay device may be manufactured in a simpler form than the ladder-type relay device. A representative example of the cantilever-type relay device is disclosed in Japanese Patent No. 3898021.

In this way, in the relay device, the movable contact point makes a linear motion or a pivotal motion with respect to the fixed contact point by the electromagnetic force of the electronic block to be contacted with or separated from the fixed contact point. Thus, the relay device generates an arc when the fixed contact point and the movable contact point are opened. The arc is not properly extinguished and raises the temperature in the inner space of the relay device. In addition, the electronic block that fluctuates the movable contact point is in the form of a coil wound on a bobbin, which raises the temperature in the inner space of the relay device due to the heat generated from the coil. In particular, due to the miniaturization trend of relay devices, the product size is getting smaller. As a result, the temperature rise in the inner space of the relay device due to the heat caused by the arc generated between the contact points and the heat generated from the electronic block tends to sensitively act to the driving of the relay device. That is, when the temperature increases in the inner space of the relay device, the surface of the contact point may be carbonized or fused not to ensure the connection of electric current which is the original function of the relay device. Also, if the temperature in the inner space of the relay device increases, the resistance value of the magnetic circuit increases, which leads to the weakening of the electromagnetic force of the electronic block, weakening the force for pulling the movable contact point, and consequently lowering the pressure at the contact point. If the pressure at the contact point is lowered, the contact resistance is increased, thereby generating more arc. Thus, there is an increasing technical or design demand to effectively radiate the heat generated in the inner space of the relay device.

SUMMARY

Technical Problem

As described above, in the relay device, the heating region includes the coil of the electronic block and the contact portion of the fixed contact point and the movable contact point. In addition, due to the miniaturization trend, the size of the relay device is becoming smaller. Thus, the heat generated from internal components of the relay device must be effectively eliminated by radiation and convection. The heat generated by the internal components can be effectively eliminated if a lot of empty space is provided inside the relay device. However, this is contradictory to the miniaturization trend and deteriorates the economic efficiency.

The present disclosure is directed to providing a relay device, which may effectively eliminate the heat generated by internal components to satisfy both miniaturization and economic efficiency.

Technical Solution

In one aspect of the present disclosure, there is provided a relay device, which includes an electronic block configured to selectively generate an electromagnetic force by means of a coil; two fixed contact point terminals at which fixed contact points are respectively installed; a movable contact point assembly having a movable contact point installed at a front end thereof, the movable contact point being fluctuated by the electromagnetic force to be contacted with or separated from the fixed contact points; and a base block configured to hold the electronic block, the fixed contact point terminals and the movable contact point assembly, which are accommodated in a cover, wherein an entire space inside the cover is divided into two regions based on a contact surface between the fixed contact point and the fixed contact point terminal, so that the region including the electronic block based on the contact surface is defined as a first space and the other region is defined as a second space, and wherein a ratio (Ve/Vt) of a volume (Ve) occupied by the second space in the entire inner volume (Vt) of the cover is 19% to 27%.

In an embodiment, a ratio (Vr/Ve) of a volume sum (Vr) occupied by components in the second space with respect to the volume (Ve) of the second space may be 21% to 42%.

In an embodiment, the fixed contact point serving as a criterion for dividing the entire space inside the cover into two regions may be a fixed contact point that comes into contact with the movable contact point when the movable contact point assembly is partially attracted by the electromagnetic force.

In another aspect, there is also provided a relay device, which includes an electronic block configured to selectively generate an electromagnetic force by means of a coil; two fixed contact point terminals at which fixed contact points are respectively installed; a movable contact point assembly having a movable contact point installed at a front end thereof, the movable contact point being fluctuated by the electromagnetic force to be contacted with or separated from the fixed contact points; and a base block configured to hold the electronic block, the fixed contact point terminals and the movable contact point assembly, which are accommodated in a cover, wherein an entire space inside the cover is divided into two regions based on a contact surface between the fixed contact point and a fixed contact point terminal, so that the region including the electronic block based on the contact surface is defined as a first space and the other region is defined as a second space, and wherein a ratio (Vr/Ve) of a volume sum (Vr) of occupied by components in the second space with respect to a volume (Ve) of the second space is 21% to 42%.

In an embodiment, the fixed contact point serving as a criterion for dividing the entire space inside the cover into two regions may be a fixed contact point that comes into contact with the movable contact point when the movable contact point assembly is partially attracted by the electromagnetic force.

Advantageous Effects

According to the embodiment of the present disclosure, by defining an optimized volume ratio of the inner space of the relay device, it is possible to effectively eliminate the heat generated from the coil of the electronic device of the relay device while simultaneously achieving miniaturization and economic efficiency.

Also, according to the embodiment of the present disclosure, by defining an optimized volume ratio between the empty space and components in the inner space where the contact points of the relay device are located, it is possible to effectively eliminate the heat generated from the coil or the contact points of the relay device while simultaneously achieving miniaturization and economic efficiency.

BRIEF DESCRIPTION OF DRAWINGS

FIG. 5 is a diagram showing a performance result according to a ratio (Ve/Vt) of a volume (Ve) occupied by a second space in an entire volume (Vt) inside the cover of the relay device according to an embodiment.

FIG. 6 is a diagram showing a performance result according to a ratio (Vr/Ve) of a volume (Vr) occupied by components in the volume (Ve) of the second space of the relay device according to an embodiment.

FIG. 7 is a diagram showing a performance result according to a ratio (Vr/Ve) of the volume (Vr) occupied by components in the volume (Ve) of the second space of the relay device according to another embodiment.

DETAILED DESCRIPTION

The above objects, features and advantages of the present disclosure will become more apparent from the following detailed description in conjunction with the accompanying drawings, by which a person skilled in the art can easily implement the technical idea of the present disclosure. Also, in explaining the present disclosure, a detailed description of known technologies related to the present disclosure will be omitted if it is deemed to unnecessarily blur the gist of the present disclosure. Hereinafter, an embodiment of the present disclosure will be described in detail with reference to the accompanying drawings.

Figure 1:
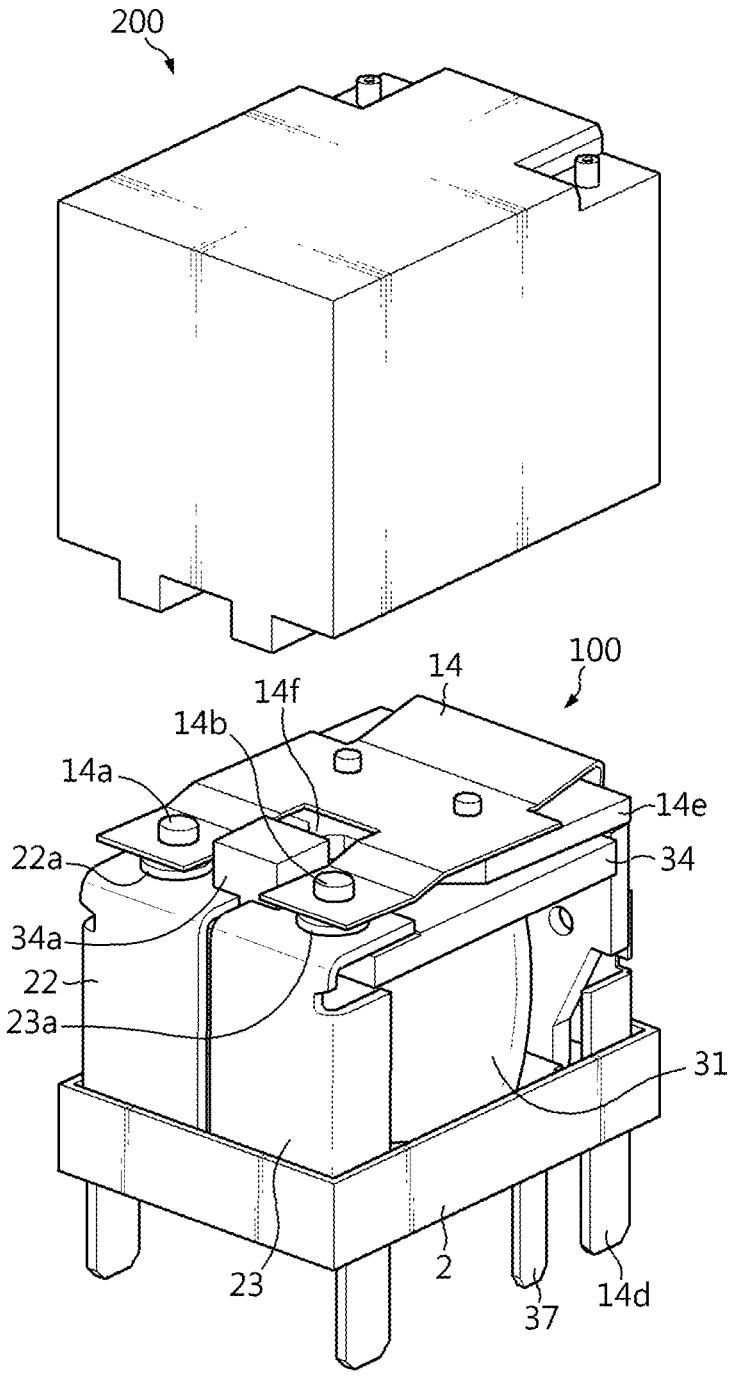
FIG. 1 is a perspective view showing a relay device according to an embodiment of the present disclosure, where a cover and a relay body are separated.
Figure 2:
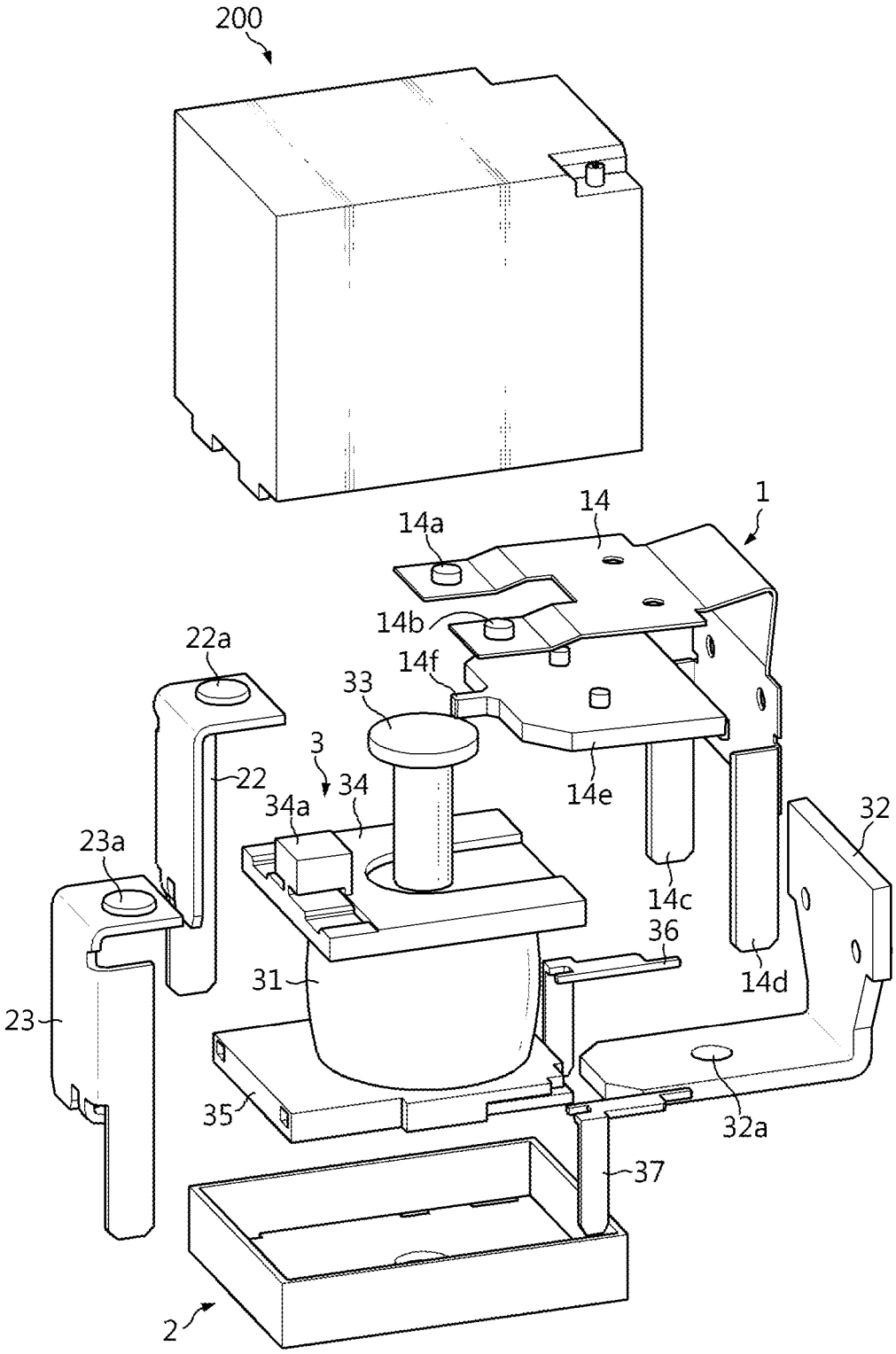
FIG. 2 is an exploded perspective showing the relay body of FIG. 1.

FIG. 1 is a perspective view showing a relay device according to an embodiment of the present disclosure, where a cover and a relay body are separated, and FIG. 2 is an exploded perspective showing the relay body of FIG. 1.

As shown in FIGS. 1 and 2, in this embodiment, the relay device includes a relay body 100 and a cover 200 for accommodating the relay body 100. The relay body 100 includes a movable contact point assembly 1 having movable contact points 14*a*, 14*b*, two fixed contact point terminals 22, 23 respectively having fixed contact points 22*a*, 23*a*, an electronic block 3 having a coil to generate an electromagnetic force by the current flowing in the coil, and a base block 2 for holding the above components.

The movable contact point assembly 1 includes a movable contact point spring 14 fluctuated by the electronic block 3, movable contact points 14*a*, 14*b* installed at one end of the movable contact point spring 14, movable contact point terminals 14*c*, 14*d* installed at the other end of the movable contact point spring 14, and a plate-shaped armature 14*e* installed at an inner side of the movable contact point spring 14.

The movable contact point spring 14 is a conductive tie plate member that has a substantially L shape to be elastically deformable. A front end of the movable contact point spring 14 extending from the movable contact point terminals 14*c*, 14*d* is split into two branches, and the movable contact points 14*a*, 14*b* are respectively installed at two front ends split into two branches.

The plate-shaped armature 14*e* attracted by a magnetic force is fixed to a center area of one side of the movable contact point spring 14. The movable contact point spring 14 is fixed to a back surface of a rising surface of a yoke 32 so that the armature 14*e* is positioned directly above a coil assembly 31 of the electronic block 3. The armature 14*e* has a plate shape as described above and includes a hooking portion 14*f* protruding at one side thereof toward the fixed contact point terminals 22, 23. The hooking portion 14*f* protrudes through a gap between the front ends of the two branches of the movable contact point spring 14. The hooking portion 14*f* is inserted into a stopper 34*a* formed at an upper flange portion 34 of the electronic block 3 and hooked by the stopper 34*a* when the movable contact points 14*a*, 14*b* are opened to suppress the vibration and noise of the movable contact point spring 14.

The fixed contact point terminals 22, 23 are installed in the fluctuation direction of the two movable contact points 14*a*, 14*b*. The fixed contact point terminals 22, 23 are formed as plate-like members, and their front ends are bent in a substantially L shape, so that the fixed contact points 22*a*, 23*a* are respectively installed at the bent front ends. One end of the fixed contact point terminals 22, 23 is inserted into the base block 2, and at the front end that is the other end of the fixed contact point terminals 22, 23, the fixed contact points 22*a*, 23*a* is disposed to be in contact with the movable contact points 14*a*, 14*b*. The fixed contact point terminals 22, 23 are provided in the number of two, and the fixed contact points 22*a*, 23*a* are respectively disposed at the other ends of the fixed contact point terminals 22, 23.

The base block 2 is formed by molding as an insulating member and has a substantially hexahedral shape with an open top, and the components of the relay device are placed inside the base block 2. That is, the electronic block 3 is inserted into the open surface of the base block 2 and placed therein, and the fixed contact point terminals 22, 23, the movable contact point terminals 14*c*, 14*d* and the coil terminals 36, 37 are inserted into the open surface of the base block 2 and then passes through the base block 2 to be exposed to the outside.

The electronic block 3 includes a coil assembly 31, a yoke 32, a core 33, flange portions 34, 35 and coil terminals 36, 37. In the coil assembly 31, a coil is wound on a coil bobbin having a hole formed at the center thereof, and both ends of the coil are connected to the pair of coil terminals 36, 37 which are fitted into the side surface of the flange portion 35 at a lower side of the coil bobbin. The yoke 32 has two planes forming an approximately right angle, namely an L shape, and a lower surface of the yoke 32 is provided parallel to the base block 2. The lower surface of the yoke 32 has a hole 32*a* that hooks and engages with the core 33. The core 33 is a shaft having a head and a body, where the diameter of the head is larger than the diameter of the body, and the body has a reduced diameter at a lower end thereof. The head of the core 33 protrudes above the upper flange portion 34 and has a larger diameter than the hole of the groove of the upper flange portion 34 so as to be hooked by the upper flange portion 34. The coil assembly 31 is placed on the lower surface of the yoke 32, and the core 33 is inserted through the hole formed in the coil bobbin and the hole 32*a* formed in the lower surface. Thus, the coil assembly 31, the yoke 32, the core 33 and the flange portions 34 and 35 are caulked so as to be integrated with each other.

If a voltage is applied to the pair of coil terminals 36, 37, an electromagnetic force is generated in the electronic block 3 configured as above, and the armature 14*e* located above the electronic block 3 is attracted so that the movable contact points 14*a*, 14*b* fluctuate downward. If the voltage is not applied further, the movable contact points 14*a*, 14*b* are opened upward by the spring action of the movable contact point spring 14.

The cover 200 has a hermetically sealed box shape having a loosely fitting opening of approximately the same size as the base block 2, and the inner surface of the opening is sealed and covered with a peripheral edge portion of the base block 2 by means of a thermosetting resin member.

In the relay device of this embodiment, before the pair of coil terminals 36, 37 are energized, the hooking portion 14*f* of the armature 14*e* is in a state of being hooked to the stopper 34*a*, and thus the movable contact points 14*a*, 14*b* keeps opened from the fixed contact points 22*a*, 23*a*. In addition, if the pair of coil terminals 31*g* are energized, the armature 14*e* is attracted to the core 33 by the electromagnetic force, so that the movable contact points 14*a*, 14*b* come into contact with the fixed contact points 22*a*, 23*a* located therebelow in a pressed state to close both contact points.

In the relay device of this embodiment, a first heating region is the coil assembly 31 of the electronic block 3, and a second heating region is the contact surface between the fixed contact points 22*a*, 23*a* and the movable contact points 14*a*, 14*b*. If the pair of coil terminals 36, 37 are energized, heat is generated from the coil wound on the coil bobbin of the coil assembly 31. Thus, a space for eliminating the heat generated from the coil is required, and also a space for eliminating the heat generated at the contact surfaces between the fixed contact points 22*a*, 23*a* and the movable contact points 14*a*, 14*b* is required. Hereinafter, the above spaces are defined with reference to FIGS. 3 and 4.

Figure 3:
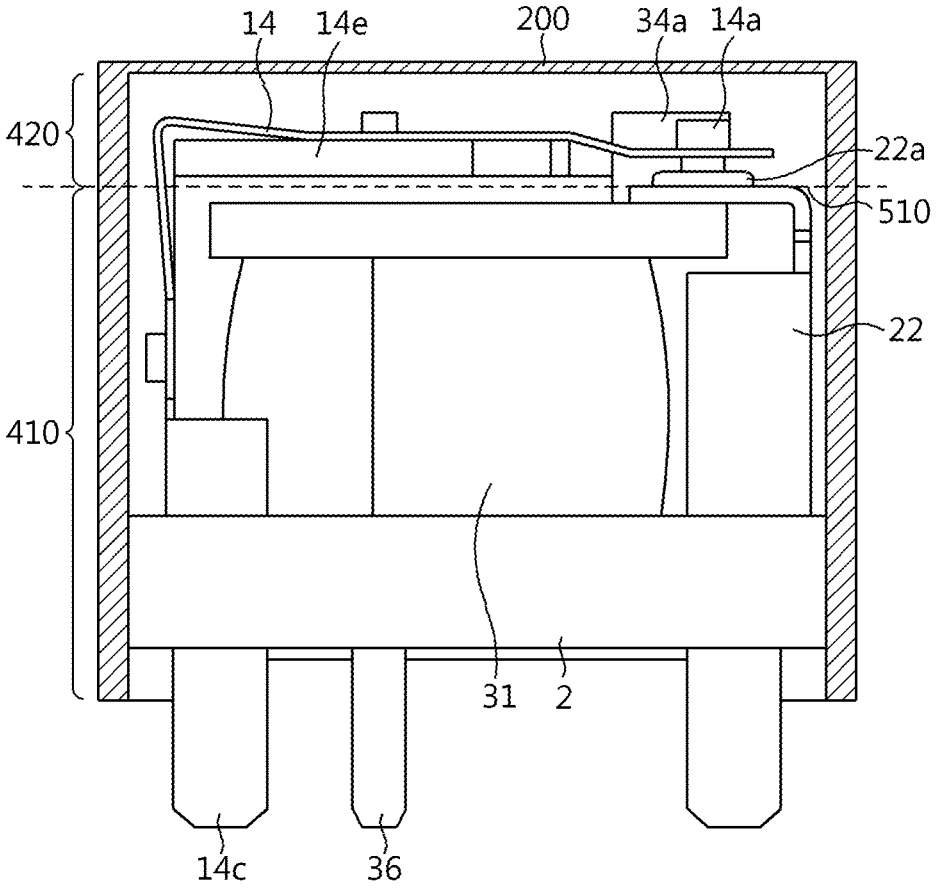
FIG. 3 is a partial sectional view showing the relay body of FIG. 1.

FIG. 3 is a partial sectional view of the relay device of FIG. 1, which shows a side surface of the relay body 100. Referring to FIG. 3, the entire space inside the cover 200 is divided into two parts based on the contact surface 510 between the fixed contact points 22*a*, 23*a* and the fixed contact point terminals 22, 23. First, a lower space based on the contact surface 510, namely a space including the electronic block 3, is defined as a first space 410, and the other space, namely an upper space based on the contact surface, is defined as a second space 420. At this time, the entire volume inside the cover 200 is Vt, the volume of the second space 420 is Ve, and the volume sum of the components in the second space 420 is Vr.

In the relay device, the first heating region is the coil assembly 31 of the electronic block 3, and, specifically, heat is mainly generated at the coil wound on the coil bobbin of the coil assembly 31. Thus, the ratio (Ve/Vt) of the volume (Ve) occupied by the second space 420 in the entire inner volume (Vt) of the cover 200 should be appropriately maintained to eliminate the heat generated in the first space 410 of the relay device by radiating and convection. This is because the heat generated at the coil located in the first space 410 is circulated by radiation and convection to the second space 420 having a relatively large empty space. If the ratio (Ve/Vt) of the volume (Ve) occupied by the second space 420 in the entire inner volume (Vt) of the cover 200 is small, the space for heat circulation is reduced, which adversely affects performance. Meanwhile, if the ratio (Ve/Vt) of the volume (Ve) occupied by the second space 420 in the entire inner volume (Vt) of the cover 200 is great, the heat removal efficiency increases, but the product size and unit cost increase, thereby weakening the product competitiveness. Preferably, the ratio (Ve/Vt) of the volume (Ve) occupied by the second space 420 in the entire inner volume (Vt) of the cover 200 is 19% to 27%. At this time, the entire inner volume (Vt) of the cover 200 is calculated by excluding a lib attached to the inner side of the cover 200. That is, the entire inner volume (Vt) of the cover 200 is calculated on the assumption that there is no lib. The lib is considered as a component as explained later when calculating the volume sum (Vr) of the components in the second space 420.

Also, the second heating region in the relay device is the contact surface between fixed contact points 22*a*, 23*a* and movable contact points 14*a*, 14*b*. Thus, if the empty space becomes insufficient as the ratio (Vr/Ve) of the volume (Vr) occupied by the components in the volume (Ve) of the second space 420 increases, the space for the circulation of the heat generated by the arc occurring when the fixed contact points 22*a*, 23*a* and the movable contact points 14*a*, 14*b* are opened by the radiation or convection is reduced. In addition, the heat generated from the first heating region, namely the coil of coil assembly 31, must circulate through the empty space of the second space 420. However, if the empty space becomes insufficient since ratio (Vr/Ve) of the volume (Vr) occupied by the components in the volume (Ve) of the second space 420 increases, the heat generated from the coil is added to the heat between the contact points, thereby adversely affecting the performance of the relay device. Meanwhile, if the ratio (Vr/Ve) of the volume (Vr) occupied by the components in the volume (Ve) of the second space 420 is lowered to increase the size of the cover 200 by increasing the size of the cover 200 to increase the volume (Ve) of the second space 420, the product size and the unit cost increase, thereby weakening the competitiveness of the product. Thus, preferably, the ratio (Vr/Ve) of the volume (Vr) occupied by the components in the volume (Ve) of the second space 420 is 21% to 42%. At this time, the components occupying the second space 420 generally include a part of the movable contact point assembly 1, the fixed contact points 22*a*, 23*a*, the stopper 34*a* formed at the upper flange portion 34 of the electronic block 3, and the lib formed at the inner side of the cover 200.

Meanwhile, if the ratio (Vr/Ve) of the volume (Vr) occupied by the components in the volume (Ve) of the second space 420 is 21% to 42%, even though the ratio (Ve/Vt) of the volume (Ve) occupied by the second space 420 in the entire inner volume (Vt) of the cover 200 is beyond the range of 19% to 27%, the relay device functions normally, and the contact point is not damaged seriously. Namely, even though the ratio (Ve/Vt) of the volume (Ve) occupied by the second space 420 in the entire inner volume (Vt) of the cover 200 is beyond the range of 19% to 27%, if the ratio (Vr/Ve) of the volume (Vr) occupied by the components in the volume (Ve) of the second space 420 is 21% to 42%, the relay device functions normally ad the contact point is not damaged seriously. This will be described later using an experiment example.

Figure 4:
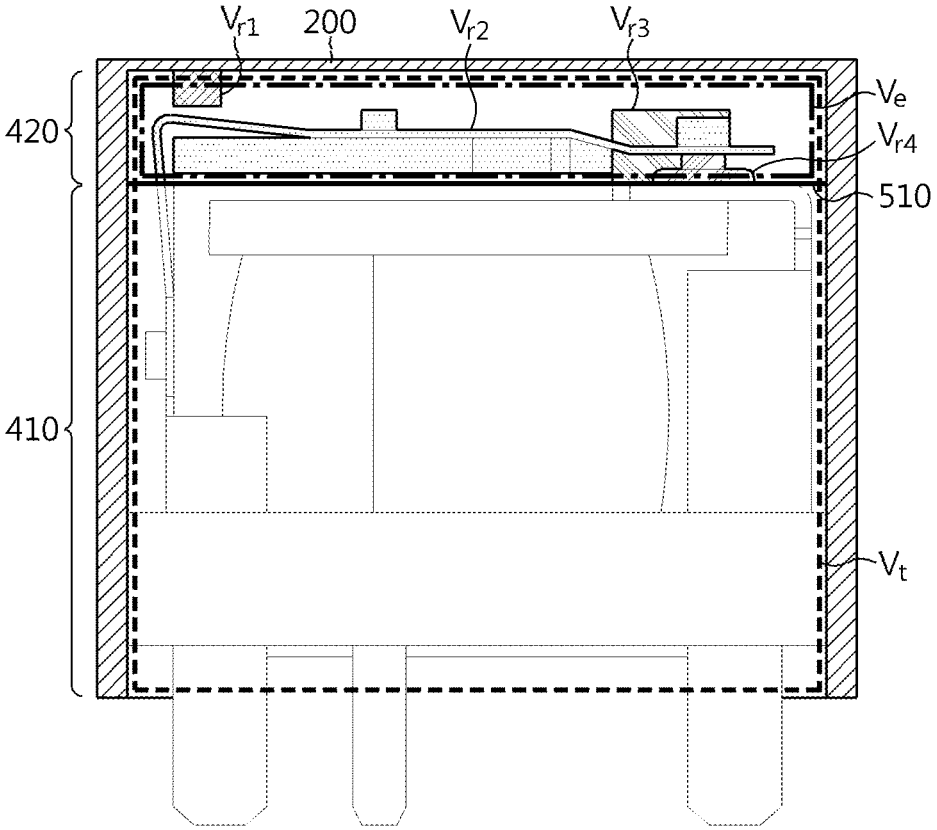
FIG. 4 is a schematic diagram for illustrating a space and a volume ratio, which are defined for the relay device in the present disclosure.

FIG. 4 is a schematic diagram for illustrating a space and a volume ratio, which are defined for the relay device in the present disclosure. In FIG. 4, Vt represents an entire inner volume of the cover 200 of the relay device. The cover 200 is generally prepared by injection-molding a plastic resin, and at this time, a lib is molded together at the inner surface of the cover 200. The lib is not considered in the entire inner volume (Vt) of the cover 200 but is considered as a component. In FIG. 4, Vr1 represents a volume of the lib present in the second space 420. As described above, the entire space inside the cover 200 of the relay device is classified into a first space 410 and a second space 420 based on the contact surface between the fixed contact points 22*a*, 23*a* and the fixed contact point terminals 22, 23. In FIG. 4, a reference sign 510 designates a base line dividing the first space 410 and the second space 420. Namely, the plane including the contact surface between the fixed contact points 22*a*, 23*a* and the fixed contact point terminals 22, 23 serves as a criterion for dividing the first space 410 and the second space 420. As shown in FIG. 4, the volume of the second space 420 is Ve. In addition, as shown in FIG. 4, if four components are present in the second space 420, the volume (Vr) occupied by the components in the second space 420 is the volume sum (Vr1+Vr2+Vr3+Vr4) of the four components.

The relay device of the above embodiment shows just the basic configuration. As a modified embodiment, the relay device may further include an arc extinction member in the second space 420. The arc extinction member includes permanent magnets and a frame for receiving the permanent magnets. Specifically, if the permanent magnets are installed at opposite sides of the fixed contact points 22*a*, 23*a* to face each other, it is possible to extinguish the arc generated while the fixed contact points 22*a*, 23*a* and the movable contact points 14*a*, 14*b* are contacted and opened. In this way, in the relay device, it is possible to add or exclude various components to or from the second space 420 depending on the product design, and the ratio (Vr/Ve) of the volume (Vr) occupied by the components in the volume (Ve) of the second space 420 may be adjusted in consideration of the volumes of the components. The ratio (Vr/Ve) of the volume (Vr) occupied by the components in the volume (Ve) of the second space 420 may be controlled by adjusting the size of the cover 200. In addition, although the relay device of the former embodiment has been described based on a cantilever type, the same principle is also applied to a different type of relay device such as a ladder-type relay device.

Hereinafter, the performance experiment result of the relay device described above with reference to FIG. 1 according to the volume ratio is described.

Preparation of a Sample

First, in order to test the performance according to the ratio (Ve/Vt) of the volume (Ve) occupied by the second space 420 in the entire inner volume (Vt) of the cover 200, the relay device configured as described above with reference to FIG. 1 was prepared. At this time, in order to minimize the influence on the performance by the components in the second space 420, the ratio (Vr/Ve) of the volume (Vr) occupied by the components in the volume (Ve) of the second space 420 was set to be 21.5%. In addition, 37 relay devices were prepared in which the ratio (Ve/Vt) of the volume (Ve) occupied by the second space 420 in the entire inner volume (Vt) of the cover 200 was increased from 16% to 34% by 0.5%. The performance experiment data of the 37 relay devices are shown in FIG. 5. In FIG. 5, Vt represents the entire inner volume of the cover 200, and Ve represents the volume of the second space 420.

Next, in a state where the ratio (Ve/Vt) of the volume (Ve) occupied by the second space 420 in the entire inner volume (Vt) of the cover 200 was 23%, 60 relay devices were prepared in which the ratio (Vr/Ve) of the volume (Vr) occupied by the components in the volume (Ve) of the second space 420 was increased from 16% to 45.5% by 0.5%. The performance experiment data of the 60 relay devices are shown in FIG. 6. In FIG. 6, Ve represents the volume of the second space 420, and Vr represents the volume sum of the components in the second space 420.

Finally, in a state where the ratio (Ve/Vt) of the volume (Ve) occupied by the second space 420 in the entire inner volume (Vt) of the cover 200 was 18%, 60 relay devices were prepared in which the ratio of the volume (Vr) occupied by the components in the volume (Ve) of the second space 420 was increased from 16% to 45.5% by 0.5%%. The performance experiment data of the 60 relay devices are shown in FIG. 7. In FIG. 7, Ve represents the volume of the second space 420, and Vr represents the volume sum of the components in the second space 420.

Measurement of Performance

Figure 8:
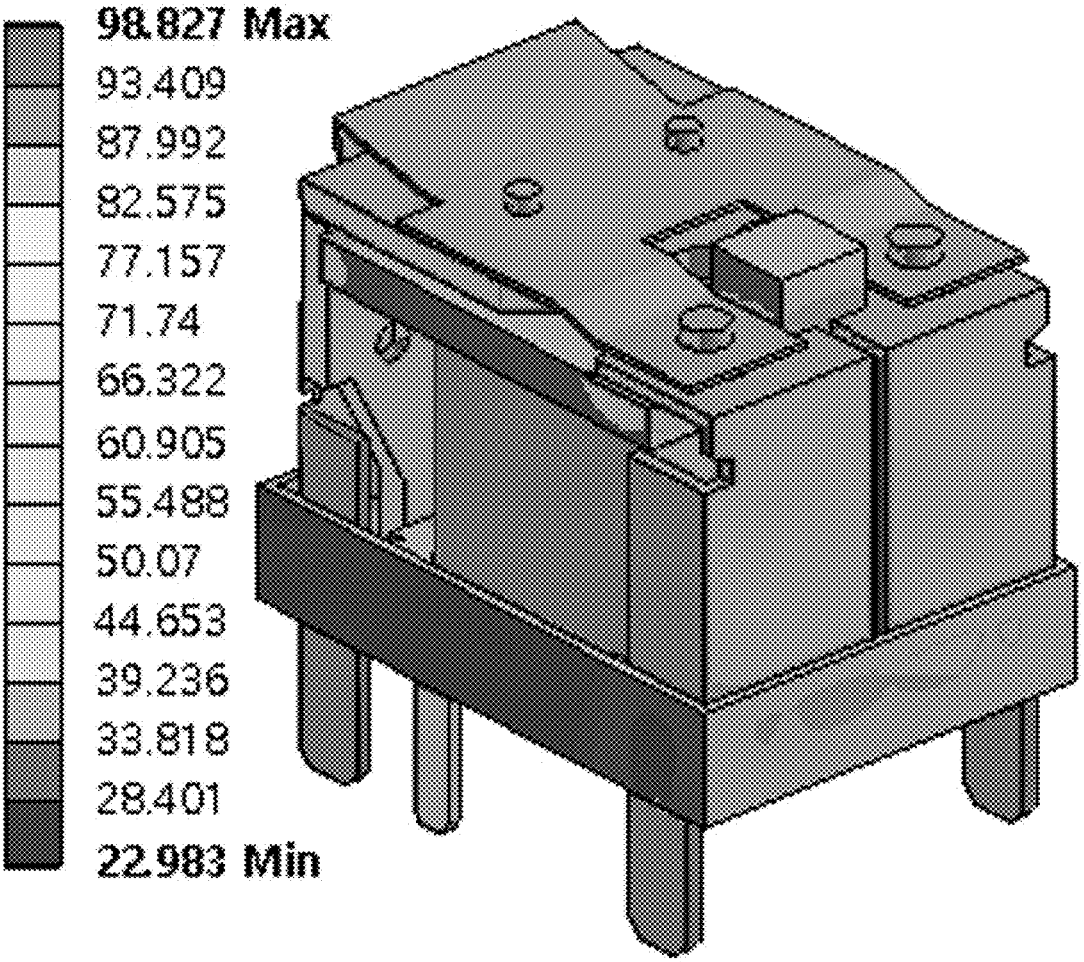
FIG. 8 is a diagram showing a thermal analysis result of the relay device where the contact point damage is in an A state.
Figure 9:
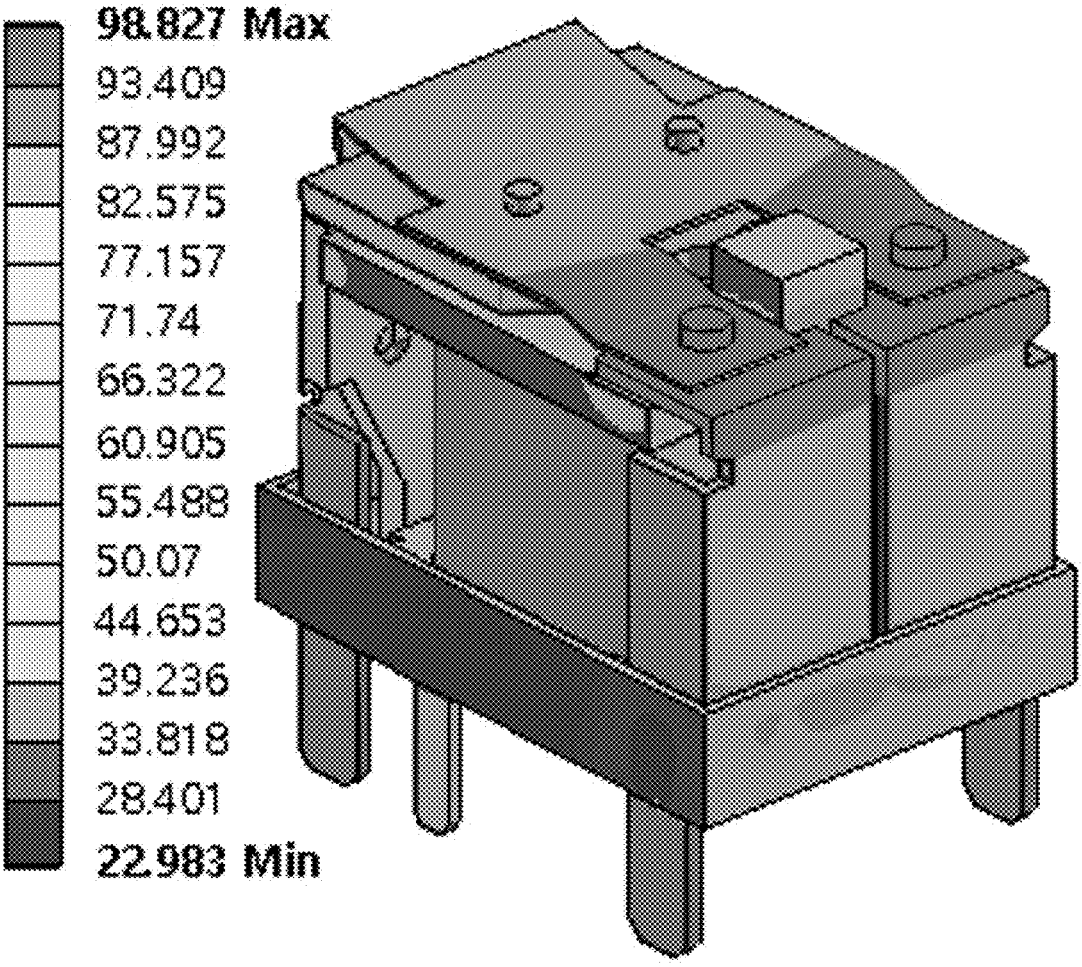
FIG. 9 is a diagram showing a thermal analysis result of the relay device where the contact point damage is in a B state.
Figure 10:
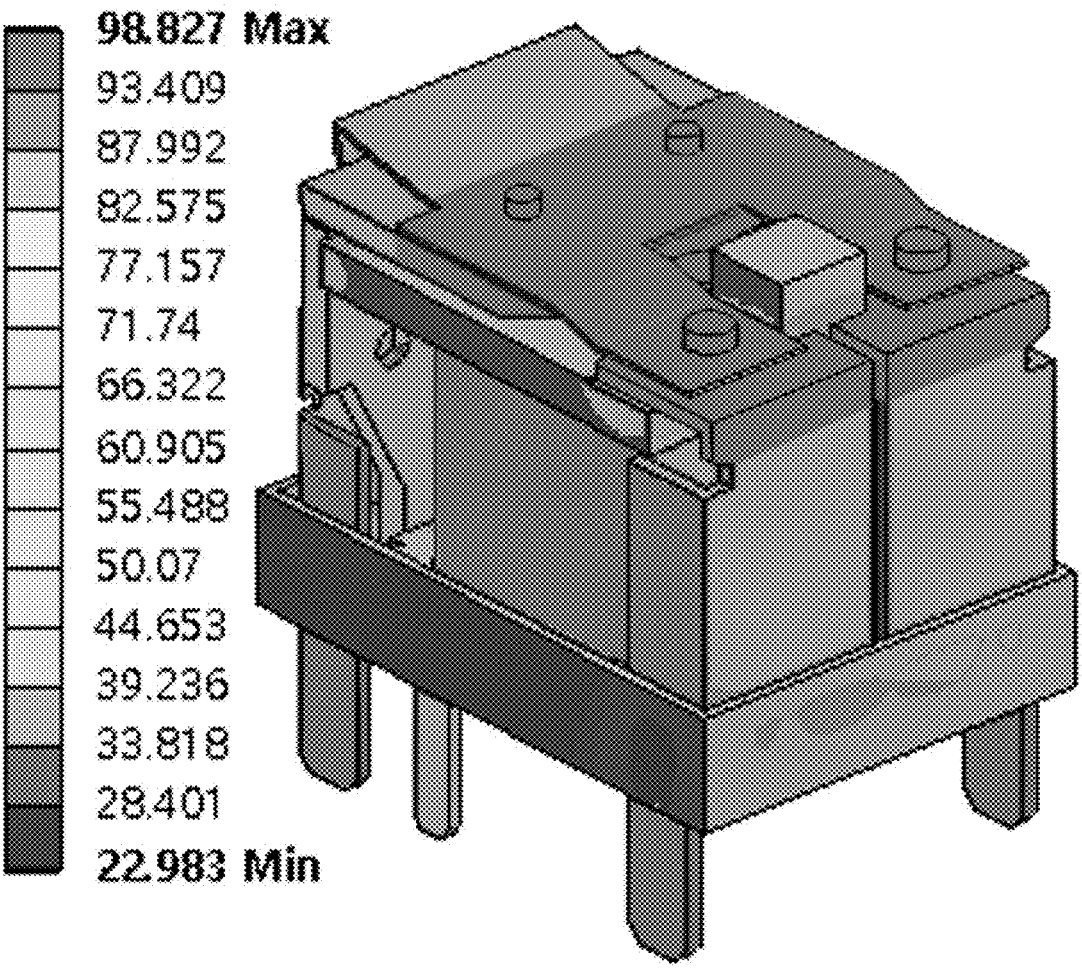
FIG. 10 is a diagram showing a thermal analysis result of the relay device where the contact point damage is in a C state.
Figure 11:
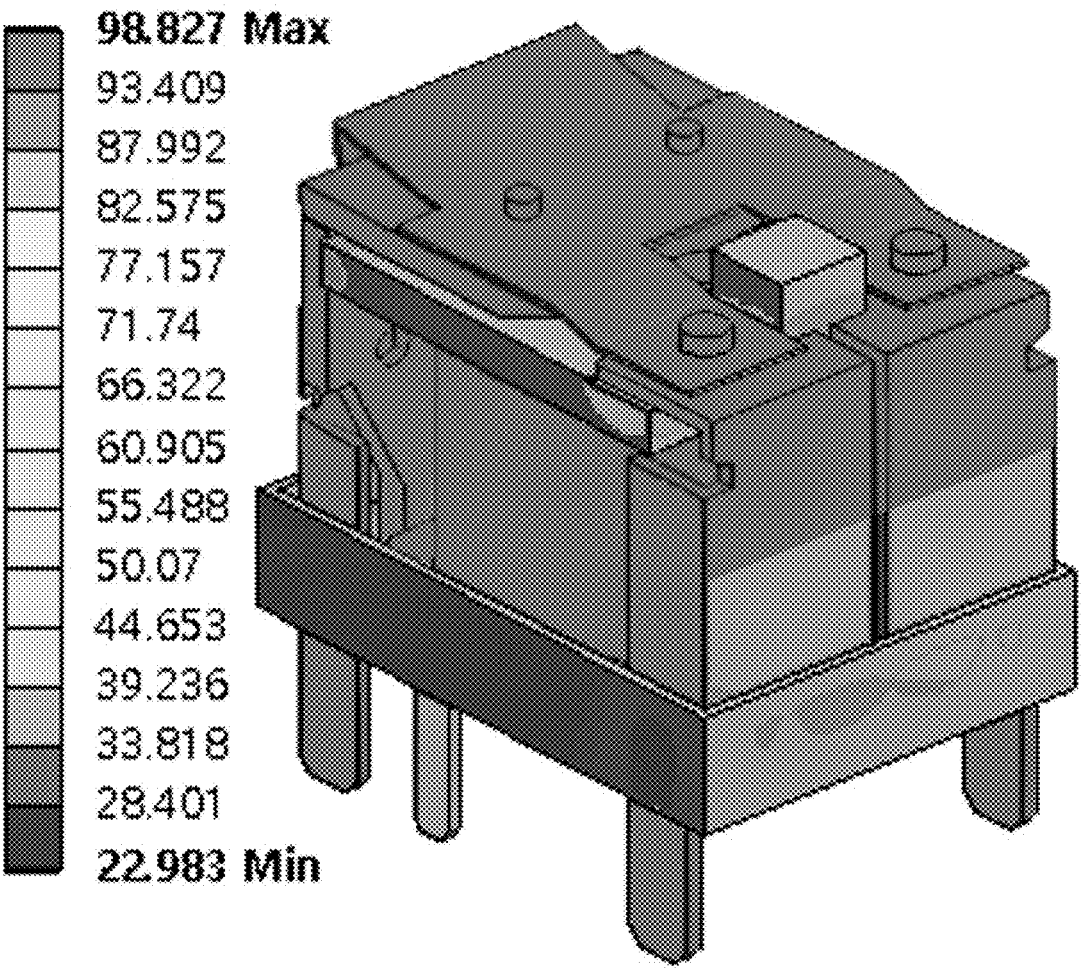
FIG. 11 is a diagram showing a thermal analysis result of the relay device where the contact point damage is in a D state.

After preparing a plurality of relay device samples as described above, the relay devices were energized with a voltage of 12V and a current of 17 A, and the relay devices were turned on and off 100,000 times at every 2 seconds. The load was a lamp load. The performance was measured according to whether the relay device was energized, whether the contact point was damaged, and the contact resistance of the contact point. The damage state of the contact point is classified into four states, namely A/B/C/D states. The A state means a state where the carbonation mark of the contact point is insignificant and the temperature difference between of the contact point and other components is insignificant. FIG. 8 is a diagram showing a thermal analysis result of the relay device in the A state. The B state means a state where the carbonation mark of the contact point is insignificant and the temperature is increased only at the contact point. FIG. 9 is a diagram showing a thermal analysis result of the relay device in the B state. The C state means a state where the carbonation mark of the contact point is observable by a microscope and the temperature is increased not only at the contact point but also at neighboring portions. FIG. 10 shows a thermal analysis result of the relay device in the C state. The D state means a state where the carbonation mark of the contact point is observable by naked eyes and the temperature is increased at the contact point, the movable contact point spring 14 and most of the fixed contact point terminals 22, 23. FIG. 11 is a diagram showing a thermal analysis result of the relay device in the D state. In FIGS. 8 to 11, the unit is ° C.

FIG. 5 is a diagram showing a performance result according to a ratio (Ve/Vt) of a volume (Ve) occupied by the second space 420 in an entire volume (Vt) inside the cover 200 of the relay device according to an embodiment. As shown in FIG. 5, when the ratio (Ve/Vt) of the volume (Ve) occupied by the second space 420 in the entire inner volume (Vt) of the cover 200 is 19% to 27% (Samples 7 to 23), the relay device can be energized and the contact point damage is in the A state that is the best state. However, if the ratio (Ve/Vt) of the volume (Ve) occupied by the second space 420 in the entire inner volume (Vt) of the cover 200 is smaller than 19% (Samples 1 to 6), the heat generated from the coil of the coil assembly 31 is not sufficiently eliminated through the second space 420, and the contact point damage comes into the B state or the C state. Meanwhile, if the ratio (Ve/Vt) of the volume (Ve) occupied by the second space 420 in the entire inner volume (Vt) of the cover 200 is greater than 27% (Samples 24 to 37), the heat generated from the coil can be fully eliminated, but the size of the cover 200 is increased as much, thereby increasing the product size and unit cost and thus weakening the product competitiveness. Thus, it may be understood that the ratio (Ve/Vt) of the volume (Ve) occupied by the second space 420 in the entire inner volume (Vt) of the cover 200 is preferably 19% to 27% in the relay device.

FIG. 6 is a diagram showing a performance result according to a ratio (Vr/Ve) of a volume (Vr) occupied by components in the volume (Ve) of the second space 420 of the relay device according to an embodiment. This diagram exhibits the performance experiment result in which the ratio (Vr/Ve) of the volume (Vr) occupied by the components in the volume (Ve) of the second space 420 is changed in a state where the ratio (Ve/Vt) of the volume (Ve) occupied by the second space 420 in the entire inner volume (Vt) of the cover 200 is 23%. If the ratio (Ve/Vt) of the volume (Ve) occupied by the second space 420 in the entire inner volume (Vt) of the cover 200 is 23%, as shown in FIG. 5, the relay device can be energized and the contact point damage is in the A state that is the best state. However, referring to FIG. 6, even though the ratio (Ve/Vt) of the volume (Ve) occupied by the second space 420 in the entire inner volume (Vt) of the cover 200 is 23%, if the ratio (Vr/Ve) of the volume (Vr) occupied by the components in the volume (Ve) of the second space 420 is greater than 42% (Samples 54 to 60), the relay device can be energized but the contact point damage comes into the B state, and also the contact resistance becomes 26.8 ms) or above. Meanwhile, if the ratio (Vr/Ve) of the volume (Vr) occupied by the components in the volume (Ve) of the second space 420 is 42% or below (Samples 11 to 53), the relay device can be energized and the contact point damage comes into the A state, and also the contact resistance is greatly lowered to 13.2 ms) at the maximum. Meanwhile, if the ratio (Vr/Ve) of the volume (Vr) occupied by the components in the volume (Ve) of the second space 420 is lower than 21% (Samples 1 to 10), even though the contact point damage is in the A state, the size of the cover 200 is increased as much, thereby increasing the product size and unit cost and thus weakening the product competitiveness. Thus, it is desirable that in the relay device, the ratio (Ve/Vt) of the volume (Ve) occupied by the second space 420 in the entire inner volume (Vt) of the cover 200 is preferably 19% to 27%, and the ratio (Vr/Ve) of the volume (Vr) occupied by the components in the volume (Ve) of the second space 420 is 21% to 42%.

FIG. 7 is a diagram showing a performance result according to a ratio (Vr/Ve) of the volume (Vr) occupied by components in the volume (Ve) of the second space 420 of the relay device according to another embodiment. This diagram exhibits the performance experiment result in which the ratio (Vr/Ve) of the volume (Vr) occupied by the components in the volume (Ve) of the second space 420 is changed in a state where the ratio (Ve/Vt) of the volume (Ve) occupied by the second space 420 in the entire inner volume (Vt) of the cover 200 is 18%. If the ratio (Ve/Vt) of the volume (Ve) occupied by the second space 420 in the entire inner volume (Vt) of the cover 200 is 18%, as shown in FIG. 5, the relay device can be energized and the contact point damage is in the B state. However, referring to FIG. 7, even though the ratio (Ve/Vt) of the volume (Ve) occupied by the second space 420 in the entire inner volume (Vt) of the cover 200 is 18%, if the ratio (Vr/Ve) of the volume (Vr) occupied by the components in the volume (Ve) of the second space 420 is greater than 42% (Samples 54 to 60), the relay device cannot be energized and the contact point damage comes into the D state. Namely, carbonization powder is generated so much that the carbonation mark of the contact point can observed by naked eyes, and thus the relay device does not operate since it cannot be energized. This is because the space occupied by components is increased as much in the second space 420, thereby eliminating the space for heat circulation. Meanwhile, if the ratio (Vr/Ve) of the volume (Vr) occupied by the components in the volume (Ve) of the second space 420 is lower than 21% (Samples 1 to 10), the relay device can be energized and the contact point damage is in the B state. However, since the size of the cover 200 is increased as much, the product size and unit cost are increased, thereby weakening the product competitiveness. Thus, in the relay device, the ratio (Vr/Ve) of the volume (Vr) occupied by the components in the volume (Ve) of the second space 420 is preferably 21% to 42% (Samples 11 to 53) regardless of the ratio (Ve/Vt) of the volume (Ve) occupied by the second space 420 in the entire inner volume (Vt) of the cover 200.

While many features are described in the specification, such features should not be construed as limiting the scope of the present disclosure or the claims. Further, the features described in the individual embodiments herein may be combined and implemented in a single embodiment. On the contrary, the various features described in the single embodiment in the specification may be individually implemented in various embodiments or as an appropriate combination with other features.

The present disclosure is not limited by the above embodiments and the accompanying drawings since various replacements, modifications and changes can be made thereto by those skilled in the art without departing from the technical idea of the present disclosure.

What is claimed is:

1. A relay device, which includes an electronic block configured to selectively generate an electromagnetic force by means of a coil; two fixed contact point terminals at which fixed contact points are respectively installed; a movable contact point assembly having a movable contact point installed at a front end thereof, the movable contact point being fluctuated by the electromagnetic force to be contacted with or separated from the fixed contact points; and a base block configured to hold the electronic block, the fixed contact point terminals and the movable contact point assembly, which are accommodated in a cover, wherein an entire space inside the cover is divided into two regions based on a contact surface between the fixed contact point and the fixed contact point terminal, so that the region including the electronic block based on the contact surface is defined as a first space and the other region is defined as a second space, wherein the fixed contact point serving as a criterion for dividing the entire space inside the cover into two regions is a fixed contact point that comes into contact with the movable contact point when the movable contact point assembly is partially attracted by the electromagnetic force, wherein a ratio (Ve/Vt) of a volume (Ve) occupied by the second space in the entire inner volume (Vt) of the cover is 19% to 27%, and wherein a ratio (Vr/Ve) of a volume sum (Vr) occupied by components in the second space with respect to the volume (Ve) of the second space is 21% to 42%.

* * * * *